United States Patent [19]

Laney

[11] Patent Number: 4,945,730

[45] Date of Patent: Aug. 7, 1990

[54] POWER ACTIVATED TOOL WITH SAFETY POWER CELL

[75] Inventor: Mark C. Laney, Lee, N.H.

[73] Assignee: Burndy Corporation, Norwalk, Conn.

[21] Appl. No.: 350,785

[22] Filed: May 11, 1989

[51] Int. Cl.[5] ..... B25C 1/12

[52] U.S. Cl. ..... 60/635; 60/632; 227/10

[58] Field of Search ..... 60/632, 635, 636; 227/9, 10

[56] References Cited

U.S. PATENT DOCUMENTS 3,212,535 10/1965 Broske ..... 227/10 X
3,251,216 5/1966 Broske ..... 227/10 X
3,292,363 12/1966 Wahl ..... 227/9 X
3,296,792 1/1967 Hedberg et al. ..... 227/9 X
3,458,996 8/1969 Mixon et al. ..... 227/10 X

FOREIGN PATENT DOCUMENTS 243895 3/1963 Australia ..... 60/636

*Primary Examiner*—Allen M. Ostrager
*Attorney, Agent, or Firm*—Burtsell J. Kearns; Patrick J. Walsh

[57] ABSTRACT

A power actuated tool having an explosive cartridge for applying connectors to power lines wherein the tool is armed as the power tool is loaded with a cartridge and engaged with a connector, and disarmed if the tool operator disengages the connector leaving the connection unfinished.

8 Claims, 3 Drawing Sheets

POWER ACTIVATED TOOL WITH SAFETY POWER CELL

BACKGROUND OF THE INVENTION

The present invention relates to power tools for attaching connectors to electrical power distribution lines.

U.S. Pat. No. 4,722,189 assigned to Burndy Corporation is directed to an explosively operated tool for connecting a tap or branch cable to a permanently installed main power cable. The connection between main cable and tap cable is established by means of a C-shaped sleeve joining the spaced tap and main cables and by a wedge driven into the space between the cables within the C-shaped connector sleeve. Strong physical and electrical connections are established by the connector.

The tool disclosed in the '189 patent drives the wedge into the C-shaped sleeve in the space between the main cable and the tap cable as the cable connection is established. The power tool includes an anvil and power ram which engage the connector workpiece and drive the connector wedge into final position. The power tool uses an explosive charge which generates sufficient force to drive the wedge into the sleeve between main cable and tap wire. As disclosed in U.S. Pat. No. 4,722,189, the power tool and cartridge case have interrelted designs and modes of operation for safe operation.

The explosive charge includes a tubular cartridge case, a rim-fire power cell held by a supporting collar, and a power piston for transmitting explosive force to the power ram when operating the power tool. The tubular cartridge is open-ended and the collar positions the rim-fire power cell at the breech end of the cartridge. The power piston is fitted in the cartridge case ahead of the power cell for engagement with the power ram. The subassembly of power piston and power cell with supporting collar are slidably mounted within the cartridge case so that the power cell can be spaced inwardly from the breech end of the cartridge case. In the assembled cartridge case, the power cell is recessed within the case and is inaccessible to a firing pin in order to avoid premature or inadvertent firing until the power tool is armed and manipulated for safe firing by the operator. The cartridge case is loaded into the tool with a safely recessed power cell inaccessible to the firing pin. After inserting the cartridge case into a firing chamber, the tool is further manipulated so that the power ram enters the open muzzle end of the cartridge case, pushes the power piston and power cell to the breech end of the cartridge case bringing the rim-fire power cell within range of the firing pin in ready-to-fire condition. The ready-to-fire condition of the cartridge case occurs as the operator manipulates the power tool and places the anvil and power ram into engagement with a connector workpiece positioned between main and tap cables. As a result of the interrelated design of cartridge case and power tool, the power tool cannot be fired until the operator engages a connector workpiece in the course of establishing the cable interconnection. The tool then is ready to be fired.

If, for some reason, the operator decides not to fire the power cartridge and disengages the power tool from an unfinished workpiece connector, then the cartridge case will remain in the ready-to-fire position and present a hazardous condition if the tool is not immediately used or if the cartridge case is not immediately extracted from the firing chamber. The present invention, therefore, is directed to a safety arrangement by which an explosively operated tool with cartridge case in the ready-to-fire position can be disarmed and returned to a safe (not ready-to-fire) position in the event the operator decides not to fire the tool after arming it and disengages the tool from an unfinished connector workpiece.

SUMMARY OF THE INVENTION

The present invention is directed to an improvement in Explosively Actuated Tools of the kind disclosed in U.S. Pat. No. 4,722,189. The present invention utilizes a power booster cartridge as disclosed in the '189 patent in which an open-ended cartridge includes a power transmitting piston and a collar mounted power cell slidably assembled within the cartridge case. The power cell contains a powder charge sufficient to operate the tool. The power piston is positioned ahead of the power cell in the cartridge case and engages the rear end of the power ram extending into the cartridge case through its open muzzle end. When the cartridge case is fired, the explosive force of the power cell drives the power piston and power ram out of the cartridge case driving the connector wedge into place. In the not ready-to-fire condition, the power cell, particularly the rim-fire end of the power cell, is recessed inwardly of the open breech end of the cartridge case beyond contact reach of the firing pin within the power tool.

In accordance with this invention, the power tool includes a main breech assembly including a firing chamber for receiving a cartridge case. The breech end of the firing chamber is fitted with a breech plug for engaging the breech end of the cartridge case. The breech plug includes a firing pin and hammer for detonating the power cell when the power tool is in position over a connector workpiece and the tool operator wishes to finish the electrical connection.

The breech plug also is fitted with a breech pad extending into the breech chamber under the force of a compression spring. The breech pad projects from the breech plug face so that it engages the rim-fire end of the power cell when the cartridge case and tool are in ready-to-fire position. In the ready-to-fire position, the power ram of the tool extends into the open muzzle end of the cartridge case, engages the front face of the power piston, and presses the power cell in ready-to-fire confronting relation with the firing pin. The tool is now ready to fire. For its part, the spring loaded breech pad is also in engagement with the power cell having been pushed back from its normal position projecting into the breech chamber so as not to interfere with firing of the power cell.

Should the tool operator decide not to fire and disengage the tool from an unfinished connector workpiece, then by doing so the tool is disarmed. Disarming occurs as the power ram is withdrawn from engagement with the power piston thereby allowing the breech pad under the force of its compression spring to push the rim-fire power cell a short distance into the cartridge case beyond reach of the firing pin. Additionally, the breech pad maintains its position projecting into the cartridge case and keeps the rim-fire power cell away from the firing pin. In this way power tool cannot be fired unless it is engaging an unfinished connector workpiece and the breech pad is pushed back. So, the operator need not extract the cartridge case after disengaging an unfinished connector because the breech pad disarms the cartridge case and the tool cannot be fired prematurely, inadvertently or deliberately as by rapping the firing hammer.

OBJECTS OF THE INVENTION

It is a primary object of the present invention to provide a power actuated tool for installing electrical connector workpieces in which the tool disarms itself when an operator disengages the tool from a connector workpiece without firing the tool.

A further object of the invention is to provide an explosively powered tool which is armed only when it is in engagement with an unfinished connector workpiece.

A further object is to provide a power actuated connector tool which cannot be fired prematurely, inadvertently, or deliberately when the tool is not in engagement with a connector workpiece.

Other and further objects of the present invention will occur to one skilled in the art on employment of the invention in practice or upon an understanding of the following detailed description of the invention.

DETAILED DESCRIPTION OF THE DRAWING

DETAILED DESCRIPTION OF THE PREFERRED EMBODIMENT

Figure 1:
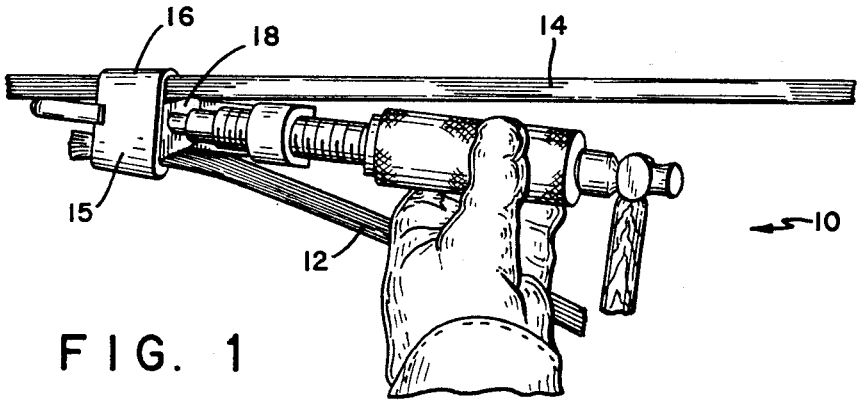
FIG. 1 is a perspective view showing the tool of the present invention in use for installing an electrical connector.
Figure 2:
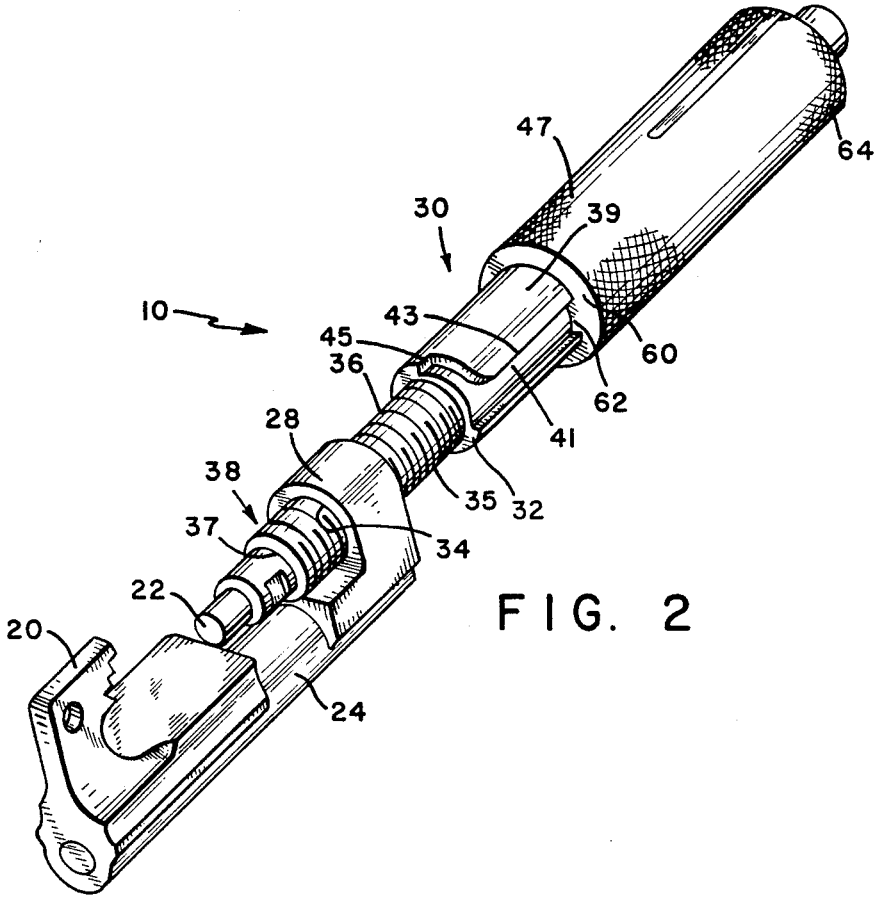
FIG. 2 is a perspective view of an explosively operated tool according to the present invention.

Referring now to the drawing, and in particular FIGS. 1 and 2, an explosively operated tool 10 according to the present invention is used for connecting a branch or tap wire 12 to a main power line 14 by means of a connector 15 which establishes a robust physical connection and an efficient electrical connection between the two cables. The connector consists of two pieces including a C-shaped sleeve 16 which couples the wires and a wedge 18 inserted between the wires in the space within the coupling. The tool shown in FIG. 1 is the explosively operated tool described in U.S. Pat. No. 4,722,189 with the improvement of the present invention being held by an operator and illustrating a hammer blow for operating the tool. As shown in FIG. 2, the power tool includes an anvil 20 and ram 22 which engage the connector workpiece in position coupling the two cables with the ram explosively powered to drive the wedge into final position. The tool further includes a base member 24 for mounting the anvil and for receiving a main breech action 26 assembly fitted through a support sleeve 28 at the other end of the base positioning the power ram along the longitudinal axis of the tool in general alignment with the anvil. The main breech action assembly 30 shown also in FIG. 3 includes a main breech member 32 inserted into the support sleeve 28 for adjustment with respect to the anvil by means of a threaded connection 34 and for advancing the power ram and the anvil into engagement with a connector workpiece during the process of establishing a power line connection. The main breech member is threaded at 35 along its forward surface 36 and includes a longitudinal axial bore 37 for receiving the power arm 22 through its muzzle end 38 and defining a firing chamber 40 for receiving a power booster cartridge 42 (FIG. 6) at its breech end 44. The main breech member terminates in a cylindrical housing 39 of greater diameter than the forward surface which accommodates the firing chamber lying along the longitudinal axis x-y of the tool. The firing chamber housing is generally cylindrical and includes on its outer surface a slot 41 having longitudinally 43 and circumferentially 45 extending segments for receiving and guiding a breech housing assembly 47.

The power ram 22 extends into the longitudinal bore 37 and into the firing chamber 40 for transmitting the booster force to a connector workpiece. The ram has greater and lesser diameters with the lesser diameter forward portion 46 being slidably supported by an end bearing 48 securely threaded into the muzzle end 38 of the bore. A crusher sleeve 50 and stop ring 52 are fitted onto the ram adjacent its interdiameter shoulder 54 for engagement with the confronting rear face 56 of end bearing when the power ram is driven forward by the booster cartridge. The breech end of the main breech member includes a captive extractor 58 for extracting each spent cartridge case from the firing chamber.

The breech housing and breech plug assembly 47 is slidably fitted over the firing chamber housing for loading, firing, and extracting booster cartridge cases in the firing chamber and for disarming the tool whenever it is removed from an unfinished workpiece without the power cell being detonated. The front face 60 includes an integral key 62 engaging slot 41 for guiding the breech housing 47 through longitudinal and circumferential movements on the firing chamber housing.

Figure 3:
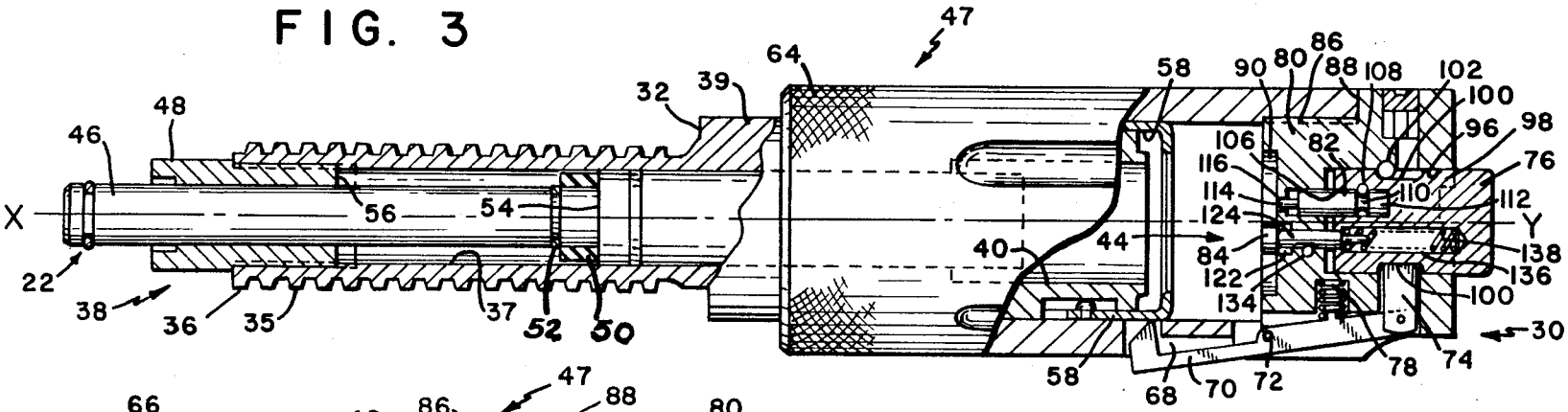
FIG. 3 is a side elevational view partly in section of the main breech action assembly of the power tool according to the present invention.
Figure 4:
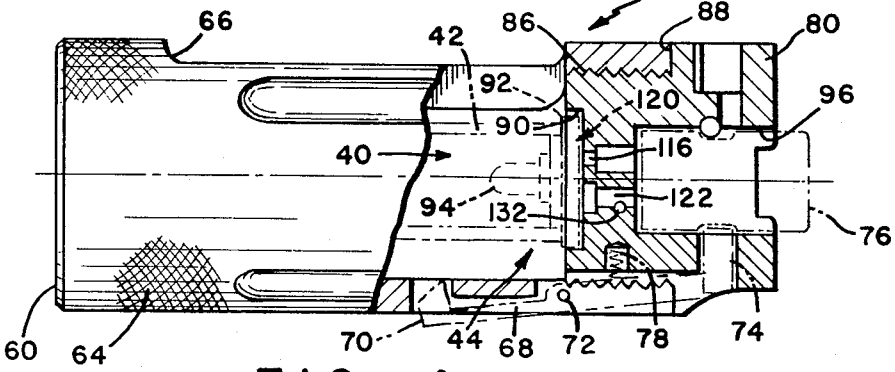
FIG. 4 is a side elevational view partly in section of the breech plug and breech housing assembly.

The breech housing is generally cylindrical with a knurled outer surface 64, and a window or breech opening 66 for inserting cartridges into the firing chamber 40. The breech housing also includes a longitudinally extending slot 68 for receiving a safety latch 70 on pivot pin 72 which cooperates with a hammer block 74 to prevent movement of a hammer 76 until the cartridge case is in the firing chamber, the breech housing closed, and the breech housing rotated to remove the hammer block as detailed below. A compression spring 78 tends to rotate the safety latch clockwise as shown in FIG. 3.

The breech plug 80 encloses the breech end 44 of firing chamber 40 and is fitted with hammer mechanism 76, firing pin 82, and safety breech pad 84. The breech plug is secured into the rear end of breech housing by suitable means such as a threaded connection 86. When in place the breech plug shoulder abuts the end face of the firing chamber housing forming a gas tight seal 88. The front face of breech plug is recessed 90 to receive the flanged breech end 92 of a cartridge case 42 with rim-fire power cell 94 in range of firing pin and with the cartridge case held firmly in the firing chamber. Additionally, the breech pad 84 protrudes from breech plug face into the recess 89 engaging the cartridge case 42.

The hammer mechanism 76 occupies a rearwardly open cavity 96 in the breech plug 80 and comprises a generally cylindrical body 98 having a circumferentially extending recess 100 of prescribed width which defines the axial distance travelled by the hammer and firing pin when the hammer actuates the firing pin. A retaining pin 102 carried in a lateral bore 104 in the breech plug extends laterally through the hammer recess and limits the axial distance of travel of the hammer while securing the hammer in the breech plug. The recess 100 is also engaged by the hammer block 74 to prevent hammer movement until the tool is properly armed and ready to fire.

The firing pin 82 is carried by the hammer in a frontward opening cavity 106 and is securely retained therein by a retaining pin 108 occupying a groove 110 in firing pin surface 112. The firing pin tip 114 protrudes through an opening 116 in breech face into the firing chamber for firing a cartridge.

Figure 5:
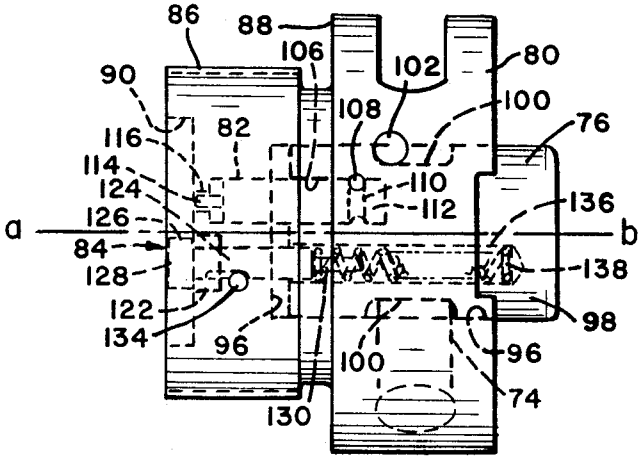
FIG. 5 is a side elevational view of the breech plug of the present invention.

As shown in FIG. 5, the firing pin extends through opening 116 in breech face just above the horizontal axial plane a–b of the breech plug so that the pin has access to rear face 118 of power cell 94 through the open breech end 120 of the cartridge case. In a preferred arrangement of hammer and firing pin, the pin will protrude approximately 0.015 to 0.020 inches into the firing chamber when detonating a cartridge.

The breech pad 84 is received in a longitudinally extending opening 122 in the breech plug just below the horizontal axial plane a–b of the breech plug so that the pad has access to the power cell 94 through the open breech end 120 of the cartridge case. The breech pad comprises a cylindrical main body 124, a forward disc shaped pad 126 with flat front face 128 and a rearward spring retaining finger 130. The main body is recessed at 132 to accommodate a breech pad pin 134 for retaining the breech pad within prescribed limits of longitudinal movement. In the fully extended position the breech pad will extend a distance greater than the excursionary range of the firing pin, i.e., a distance greater than the 0.015–0.020 inch protrusion of the firing pin in a preferred arrangement.

The spring retaining finger 130 extends into a spring cavity 136 of the hammer for receiving a compression spring 138. The compression spring tends to push the breech pad into the firing chamber up to the prescribed limit of travel. By means of reaction force the spring will also urge the hammer and firing pin away from the firing chamber to the limit of its axial distance of travel.

Figure 6:
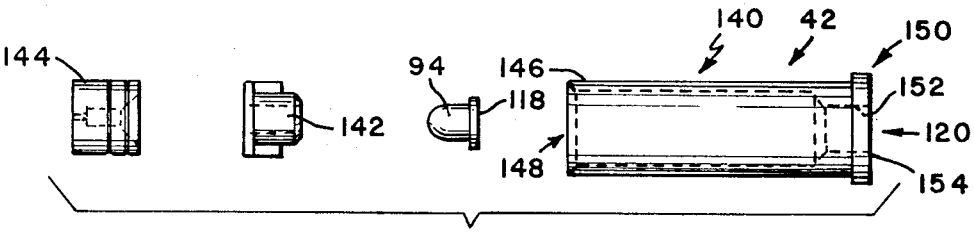
FIG. 6 is an exploded view of a cartridge case used with the power tool of the present invention.

The cartridge case is shown in FIG. 6 and includes open ended shell casing 140, a power cell 94, a supporting collar 142 for the power cell, and a power piston 144 for engaging and driving the power ram when the cartridge is detonated. The shell casing 140 is an elongated tube 146 with open muzzle end 148, a flanged breech end 150 and with an opening 152 in its breech face 154 exposing the power cell 94. The power piston and the power cell collar slide into the shell casing and when assembled to the exposed firing face of the power cell is located safely inside the shell casing out of reach of the tool's firing pin.

Figure 7:
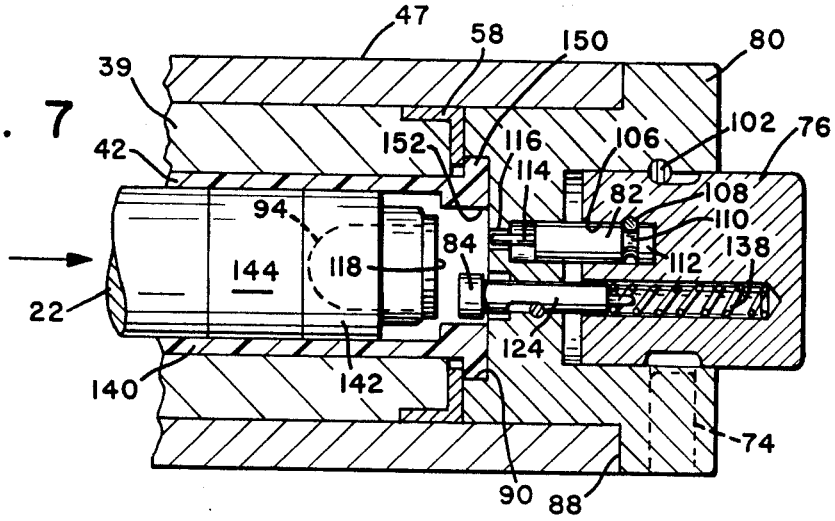
FIGS. 7, 8 and 9 are schematic sequential views of the tool of the present invention showing the tool being armed with the cartridge case moved to a read-to-fire position and with the cartridge case thereafter moved to a not ready-to-fire position.
Figure 8:
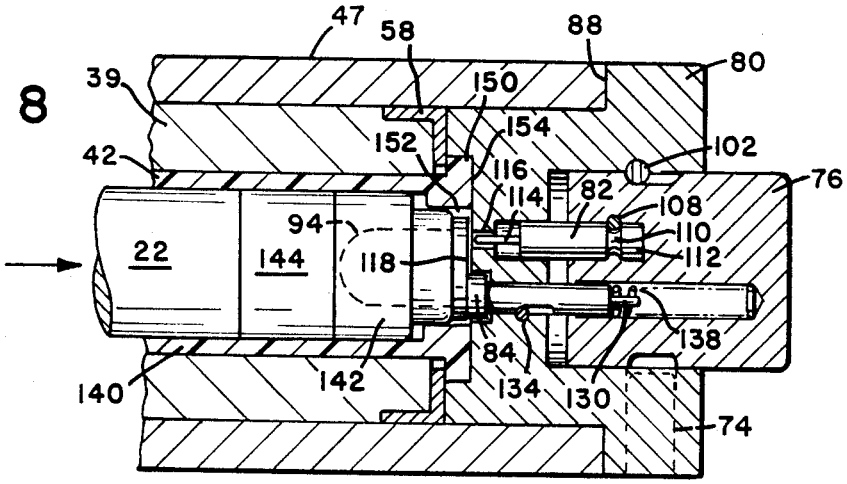
Figure 9:
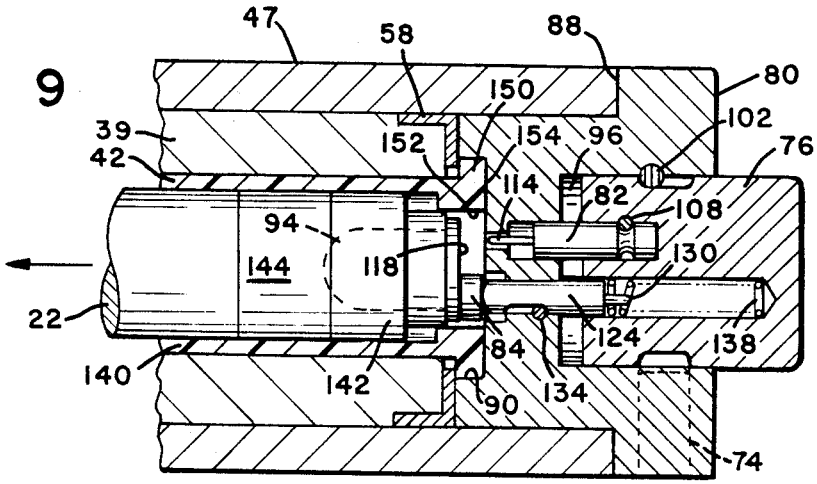

FIGS. 7, 8 and 9 illustrate in sequence the safety features of the invention during operation and are used for general reference in summarizing operation of the tool.

Referring first to FIGS. 2 and 3, the tool is loaded by first moving breech housing to its rearmost position on main breech assembly and inserting a safe cartridge (power cell recessed) through breech housing window and extractor opening into the firing chamber. Next the breech housing is pushed forward and rotated on the firing chamber housing approximately one-quarter with key riding in the longitudinal and circumferential portions of housing slot. The longitudinal component of this movement closes breech plug against the firing chamber with the cartridge flange residing in the breech plug recess and with the breech pad confronting the recessed power cell as shown in FIG. 7. Additionally this movement engages the hammer block as the safety latch tip engages the extractor body moving the hammer block counter clockwise into position. The circumferential component of breech housing movement disengages hammer block from the hammer groove so the firing pin can be advanced as the safety latch tip falls into a slot (not shown) in firing chamber housing and the hammer block and safety latch move clockwise.

Now the operator is ready to engage a connector workpiece and advances the power ram by forward rotation of main breech assembly through its support sleeve. When the ram tip engages the connector wedge, relative movement occurs between ram and main breech assembly so the ram breech end enters the cartridge case engaging the front face of power piston and pushing it and the power cell rearwardly from the position of FIG. 7 to that of FIG. 8. Here the breech pad is pushed out of the way and the firing pin is in range of the power cell. The tool is ready to fire and is detonated by a hammer blow of FIG. 1.

If the operator decides not to fire the tool after it reaches the position of FIG. 8 and disengages the tool from the unfinished workpiece by reverse rotation of the main breech member, then the pushing force of ram breech end against power piston is released and the breech pad advances against the power cell and pushes it into the interior of the cartridge case out of range of the operational execursion of the firing pin to the position shown in FIG. 9. The tool is disarmed and now cannot be fired.

I claim:

1. An explosively actuated tool in combination with a cartridge for forming a connection between main and branch cables comprising:

a base member having a fixed anvil and an upstanding support member having a sleeve for positioning a power ram in alignment with the anvil, a main breech action assembly carried by the support member and including a power ram, a firing chamber housing, and a breech assembly, the breech action assembly including an elongated tube having a forward portion mounted in the support member and a rear portion defining a firing chamber housing, the tube having an axial bore for receiving and projecting the power ram in alignment with the anvil, the axial bore further defining the firing chamber for receiving the cartridge case, the power ram in the axial bore having a ram end aligned with and adapted for cooperation with the anvil for finishing a connector and a breech end extending into the firing chamber, the breech assembly including a cylindrical housing telescoped into the firing chamber housing and a breech plug for closing the breech end of the firing chamber, a firing pin and a breech pad carried by the breech plug in operative relation with the firing chamber, a cartridge case in the firing chamber having a power piston and a power cell slidably received therein, means for extending the breech end of the power ram into the firing chamber for pressing the power cell against the breech plug in range of the operative excursion of the firing pin when the tool is in engagement with a connector workpiece, and means for moving the power cell out of range of the firing pin when the ram is retracted from the firing chamber.

2. An explosively actuated tool using a power cartridge for forming a connection between main and branch cables comprising:

a base member having a fixed anvil and an upstanding support member having a sleeve for positioning a power ram in alignment with the anvil, a main breech action assembly carried by the support member and including a power ram, a firing chamber housing, and a breech assembly, the breech action assembly including an elongated tube having a forward portion mounted in the support member, the tube having an axial bore for receiving and projecting the power ram from the forward portion of the base in alignment with the anvil, the rear portion of the elongated tube defining the firing chamber housing with the axial bore defining the firing chamber for receiving a power cartridge, the power ram in the axial bore having a ram end aligned with and adapted for cooperation with the anvil for finishing a connector and a breech end extending into the firing chamber, the breech assembly including a cylindrical housing telescoped into the firing chamber housing and a breech plug for closing the breech end of the firing chamber, the breech plug having a firing pin in operative relation with a power cartridge in the firing chamber having a power piston and a power cell slidably received therein, means for moving the breech end of the power ram into the firing chamber for pressing the power cell against the breech plug in range of the operative excursion of the firing pin when the power ram and anvil are in engagement with an unfinished connector workpiece, and the breech plug having means for moving the power cell out of range of the firing pin when the power ram and anvil are disengaged from the unfinished connector workpiece.

3. A tool according to claim 2 in which the breech plug has a firing pin for detonating the power cell and a breech pad for moving the power cell away from the firing pin.

4. A breech housing assembly for an explosively actuated tool having a firing chamber, a power cartridge in the firing chamber and a power ram for engaging moving the cartridge toward the breech end of the firing chamber comprising a breech housing slidably fitted over the firing chamber and having an opening for inserting a cartridge into the firing chamber, a breech plug secured to one end of the breech housing for movement with the breech housing assembly to close the breech end of the firing chamber, the breech plug having:

a front face to receive the breech end of a cartridge case, a firing pin adapted to protruding through the front face and having an excursionary range for detonating the power cartridge, a hammer for actuating the firing pin, and a spring loaded breech pad projecting from the front face of the breech pad and engaging the breech end of the cartridge case for pushing the catridge case out of range of the firing pin when the power ram is disengaged from the cartridge.

5. An assembly according to claim 4 in which the front face of breech plug is recessed.

6. In a power tool with a firing chamber, having a longitudinal axis, a power cartridge in the firing chamber, and a power ram engaging the cartridge and pushing the cartridge toward the breech end of the firing chamber, a breech plug comprising a plug body having a breech face for receiving the breech end of a cartridge case, a rearwardly open cavity having a hammer mechanism therein, means for limiting the axial distance of travel of the hammer mechanism, a firing pin carried by the hammer and having a firing pin tip protruding through an opening in the breech face to fire a cartridge, the hammer and firing pin having a predetermined excursionary range for firing a cartridge, a breech pad carried by the breech plug and protruding from the breech face, means for urging the breech pad to protrude from the breech face, means for limiting the axial movement of the breech pad, so that the breech pad moves a cartridge beyond the operational range of the firing pin when the power ram disengages the cartridge.

7. A breech plug according to claim 6 in which the breech face is recessed.

8. A power tool for applying a connector between main and branch cables comprising an interconnected anvil and power ram, a main breech assembly for advancing the power ram for engaging a connector between the power ram and the anvil so that the tool is in ready-to-fire condition, and means for disabling the power device when the power ram is disengaged from the connector leaving the connector unfinished.

* * * * *